United States Patent [19]

Wetteland

[11] 4,161,323

[45] Jul. 17, 1979

[54] SNOW SKI BOARD APPARATUS

[76] Inventor: Maxwell T. Wetteland, 5225 Empire Dr., North Burnaby, British Columbia, Canada, V5B 1N1

[21] Appl. No.: 838,597

[22] Filed: Oct. 3, 1977

[51] Int. Cl.[2] ..... A63C 17/18; B62B 13/04; B62B 19/02

[52] U.S. Cl. ..... 280/7.12; 280/13; 280/16; 280/28; 280/87.04 A

[58] Field of Search ..... 280/87.04 A, 87.04 R, 280/7.12, 7.13, 7.14, 600, 609, 12 H, 15, 16, 21 R, 28, 13

[56] References Cited

U.S. PATENT DOCUMENTS

| | | | |
|---|---|---|---|
| D. 179,367 | 12/1956 | Allen et al. | 280/609 |
| 921,109 | 5/1909 | Henle | 280/13 |
| 1,802,116 | 4/1931 | Kinsley | 280/7.13 |
| 2,437,622 | 3/1948 | Stryker | 280/13 |
| 3,030,123 | 4/1962 | Dworak | 280/16 |
| 3,153,543 | 10/1964 | Magyar | 280/13 |
| 3,203,706 | 8/1965 | Boyden | 280/87.04 R |
| 3,632,126 | 1/1972 | Shorrock | 280/28 |
| 3,643,978 | 2/1972 | Westberg | 280/28 |
| 4,043,565 | 8/1977 | Mogannam | 280/87.04 A |

FOREIGN PATENT DOCUMENTS

| | | | |
|---|---|---|---|
| 898865 | 4/1972 | Canada | 280/15 |
| 1958349 | 5/1971 | Fed. Rep. of Germany | 280/609 |
| 55063 | 4/1935 | Norway | 280/609 |
| 572411 | 2/1976 | Switzerland | 280/13 |

*Primary Examiner*—David M. Mitchell
*Attorney, Agent, or Firm*—Townsend and Townsend

[57] ABSTRACT

Snow ski apparatus that can be removably attached to a standard roller skate board or form part of a roller skate board arrangement. The apparatus includes a fore ski section and a rear ski section in longitudinal alignment to be connected respectively to the front axle and the rear axle of a roller skate board. As each axle of the skate board is mounted for limited turning movement, the ski sections of the resulting ski board can be manipulated in substantially the same manner as the rollers of an ordinary roller skate board. The adjacent ends of the ski sections are interconnected by a resilient connector.

10 Claims, 8 Drawing Figures

SNOW SKI BOARD APPARATUS

Figures 1, 2, 3, 6:
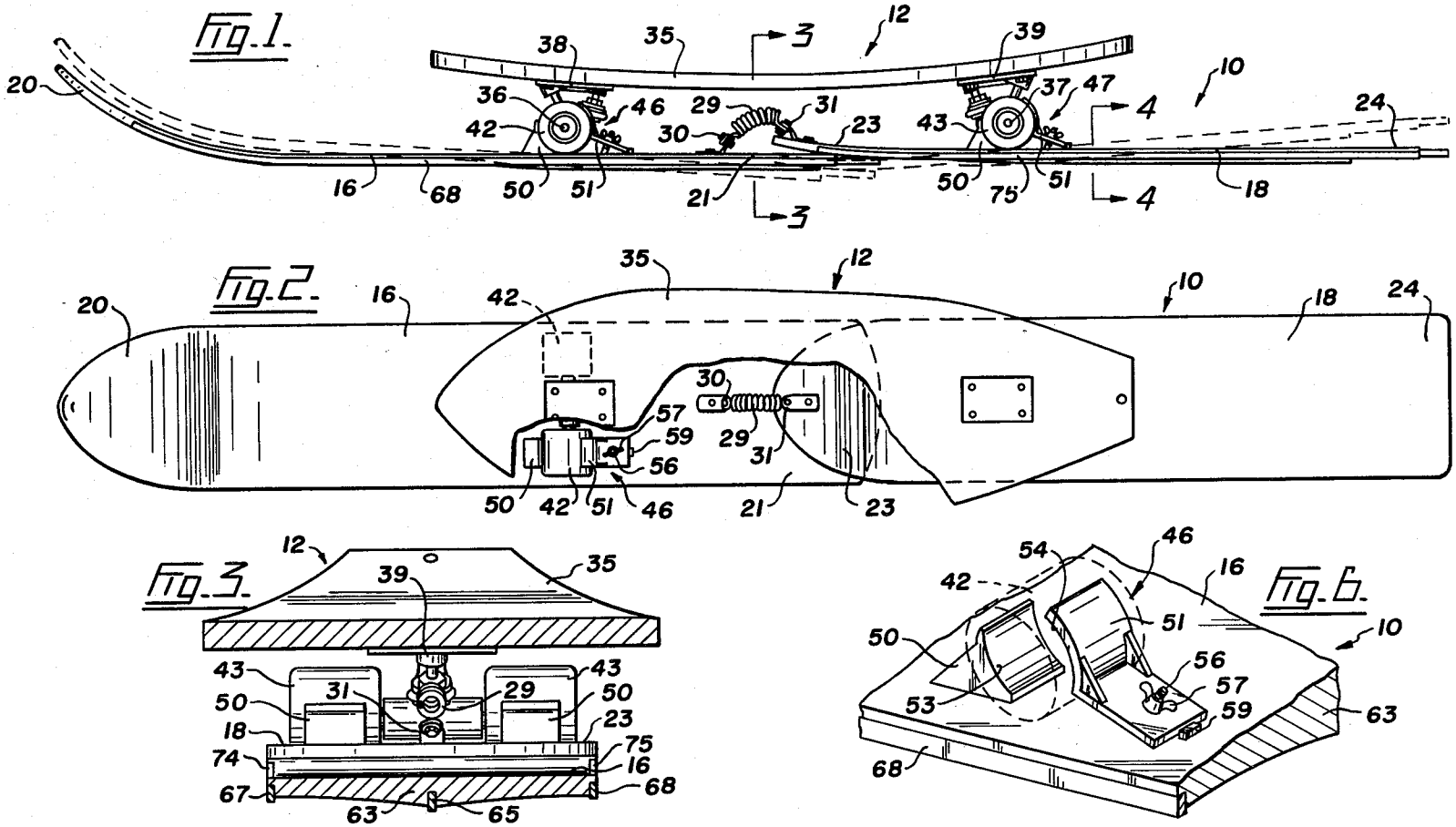

This invention relates to snow ski board apparatus that can be manipulated on snow in much the same way as an ordinary roller skate board is manipulated on a relatively hard surface. The ski apparatus is preferably such as to be removably secured to a roller skate board, but it can be permanently incorporated in a skate board structure. Some effort has been made in the past to produce scooter-like devices that can be operated on snow, but they have not been very successful as evidenced by the fact that they are not on the market. Some of these prior devices are discussed in the following paragraphs.

U.S. Pat. No. 1,560,928, dated Nov. 10, 1925, discloses a scooter sled which is similar to a bob sled but having only one pair of longitudinally aligned runners. The rear runner is fixed to the platform upon which the user's foot rests, while the front runner is turned by means of a handle. This device can operate only on a fairly hard surface, such as packed snow, and the user cannot use his body weight to effect steering.

U.S. Pat. No. 2,062,800, dated Dec. 1, 1936, covers a vehicle having a seat for the user and a place for his feet. This vehicle has pairs of wheels at its opposite ends, but a single runner can be attached to the wheels. The user is unable to steer the patented vehicle.

U.S. Pat. No. 3,153,543, dated Oct. 19, 1964, discloses a combination roller skate and ski scooter. This device has pairs of wheels at its opposite ends. A single ski or runner can be attached to the pairs of wheels. The ski or runner has additional upwardly projecting springs which fit into slots in the supporting platform at the opposite ends thereof. This scooter can be manipulated only in the same manner as an ordinary ski.

U.S. Pat. No. 3,378,274, dated Apr. 16, 1968, merely discloses a single ski which is wide enough to be used alone and includes two foot treads in alignment upon which the user can place his feet.

U.S. Pat. No. 3,628,804, dated Dec. 21, 1971, discloses a single board which is somewhat similar to a surf board and has a braking arrangement at the back end thereof which is operated by rocking the board rearwardly. The user places his two feet on this board.

An important feature of the present snow ski board apparatus is the fact that it can be removably attached to an ordinary roller skate board. The ski arrangement is such that the resulting apparatus can be manipulated in exactly the same manner as a roller skate board, although it is used on snow. Thus, the skate board can easily be adapted for use in the snow. As a result, the person owning a roller skate board can use it in snow countries in both summer and winter. On the other hand, the present snow ski apparatus can be incorporated in a ski board type of apparatus without the normal wheels or rollers of a skate board.

The snow ski apparatus in the preferred form of this invention includes two longitudinally aligned ski sections with means for removably connecting them to the front and rear axles of a roller skate board. As the axles of these skate boards are able to turn laterally to a limited degree, the ski sections can be turned in the same manner as the standard rollers of the skate board. In addition to this, each ski section is provided with means for biting into the snow when the apparatus is travelling in a straight line, and when it is turning through a curve either to the left or to the right. A flexible connector interconnects the adjacent ends of the ski sections. This connector allows the front end of the rear section to swing a little to one side of the apparatus when the front or fore ski section is turning towards the opposite side while ensuring that the rear section follows the fore section. This enables the apparatus to make a much sharper turn than would otherwise be possible. In addition, the connector acts as a shock absorber, and it keeps the front end of the rear ski section in its proper position relative to the back end of the fore section at all times.

Snow ski apparatus in accordance with this invention comprises a fore ski section having a front end and a back end, a rear ski section having a front end and a back end, said rear section being immediately behind and in longitudinal alignment with the fore section, a flexible connector connecting the front end of the rear section to the back end of the fore section, first connecting means on the fore section between the ends thereof for connecting said fore section to the front axle of a roller skate board, and second mounting means on the rear section between its ends for connecting said rear section to the rear axle of the skate board, said connector allowing limited relative vertical and horizontal movement between the fore ski section and the rear ski section.

Figure 4:
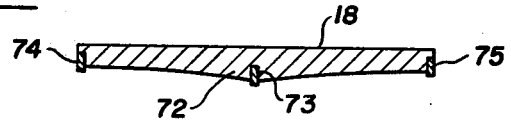
Figure 5:
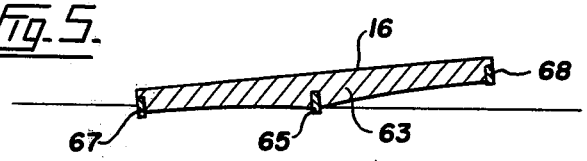
Figure 7:
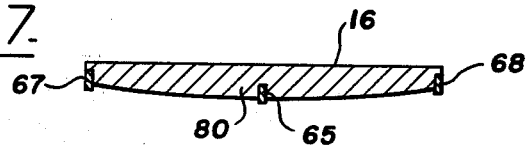
Figure 8:
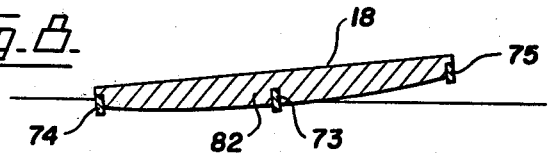

Illustrated examples of this ski board apparatus appear in the accompanying drawings, in which FIG. 1 is a side elevation of a preferred form of ski apparatus, FIG. 2 is a plan view of this apparatus, FIG. 3 is an enlarged sectional view taken on the line 3—3 of FIG. 1, FIG. 4 is an enlarged cross section taken on the line 4—4 of FIG. 1, FIG. 5 is a sectional view substantially on 3—3 of FIG. 1 illustrating the attitude of the fore ski section during a turning manouever, FIG. 6 is an enlarged perspective view of a clamp for securing the ski apparatus to a roller skate board, FIG. 7 is a cross section through the fore ski section of an alternative form of the invention, and FIG. 8 is a cross section through the rear ski section of said alternative form and illustrating the attitude of this section during a turning manoeuver.

Referring to FIGS. 1 to 6 of the drawings, 10 is snow ski board apparatus in accordance with this invention removably attached to a standard roller skate board 12. The ski apparatus 10 consists of a fore ski section 16, and a rear ski section 18 in longitudinal alignment with said fore section. The fore section has a front end 20 which is preferably curved upwardly as shown, and a back end 21. The rear ski section 18 has a front end 23 which is preferably curved upwardly, although the curvature of this end does not need to be as great or as sharp as that of the front end 20 of section 16. Section 18 has a back end 24. By referring to FIG. 1, the front end 23 of rear section 18 overlaps and is spaced above the back end 21 of section 16. This is a preferred arrangement although if desired the adjacent ends can be spaced from each other.

A suitable flexible connector preferably interconnects the front end 23 of section 18 with the back end 21 of section 16. In the preferred form of the invention, this connector is resilient and is in the form of a coil spring 29 connected at its opposite ends 30 and 31 respectively to the back end of section 16 and and the front end of section 18 in any suitable manner, such as by screws, as shown. This spring is arched or curved in the illustrated manner, and it permits a limited relative vertical and horizontal movement between the adjacent ends of the two ski sections.

The skate board 12 includes an elongate platform 35 having front and rear transverse axles 36 and 37 connected thereto by standard mounts 38 and 39. As is customary, these mounts are such that the axles can turn laterally to a limited degree. A pair of wheels or rollers 42 are mounted on the ends of axle 36 through suitable bearings, these wheels being located beneath platform 35 near the front end thereof. Another pair of wheels 43 are mounted on axle 37 through suitable bearings beneath the sides of the platform near the back end thereof.

Suitable mounting means is provided for removably connecting the ski sections 16 and 18 to axles 36 and 37. In this example, the ski sections are connected to the respective axles through wheels 42 and 43. There is a clamp 46 on fore section 16 for each wheel or roller 42, and a clamp 47 on section 18 for each wheel or roller 43. As these clamps are identical only one will now be described in detail, namely one of the clamps 46 which is illustrated in detail in FIG. 6.

The clamp 46 consists of a stationary clamping element 50 and a movable clamping element 51 opposed to element 50 and removably mounted on the fore ski section. Clamping element 50 has a curved gripping surface 53 opposed to a curved gripping surface 54 on clamping element 51. This element 51 fits onto a bolt 56 projecting upwardly from section 16, and a wing nut 57 fitted on this bolt can be turned to tighten element 51 on the ski section.

When it is desired to connected the fore ski section to front axle 36, clamping element 51 is removed from the ski section and one of the rollers 42 is placed on this section against the gripping surface 53 of element 50. Then clamping element 51 is placed on bolt 56 with its gripping surface 54 bearing against the roller diametrically opposite gripping surface 53. When nut 57 is turned down on bolt 56, the roller is firmly gripped between the gripping elements 50 and 51. A stop 59 on the upper surface on section 16 bears against the outer end of clamping element 51 to prevent the latter from swinging laterally relative to bolt 56.

When the four wheels of the skate board 12 are clamped to fore ski section 16 and rear ski section 18, the apparatus is ready for use in snow.

Although ski sections 16 and 18 may have bottom surfaces that are substantially flat in the transverse direction or have longitudinal grooves formed therein in the same manner as ordinary skis, it is preferable to form the lower or running surface of section 16 with a slight central protuberance 63 extending longitudinally thereof near the back end 21. This protuberance can extend forwardly a fair distance along the bottom of the ski section, but it preferably does not extend to the curve of the front end 20. The protuberance is pronounced at the back end of the ski section, becomes less toward the front end, and fades out to flat at said front end. In this example, the protuberance is of substantially shallow V cross section, as shown in FIGS. 3 and 5. Although not absolutely necessary, it is preferable to provide a thin shallow runner 65 extending centrally longitudinally of the lower or running surface of the fore ski section near the back end thereof. This runner extends along and projects downwardly from protuberance 63. It is also preferable to provide thin shallow runners 67 and 68 extending longitudinally of said lower or running surface adjacent each side edge of the fore section, said runners extending downwardly a little below said surface. It is also desirable to provide rear ski section 18 with a longitudinal protuberance and with runners similar to those of fore section 16, but located near the front end of the rear section. FIG. 4 is a cross section through rear ski section 18 showing the central and longitudinal protuberance 72 thereof, and a thin shallow central runner 73 extending longitudinally of this section, and side thin and shallow runners 74 and 75 at opposite sides of the section. The protuberance 72 starts near the front end of the rear section at the base of curvature of said front end, becomes less towards the back end of the section and fades out to flat at said back end.

FIGS. 7 and 8 are cross sections respectively through the fore ski section and the rear ski section substantially at section lines 3—3 and 4—4 of FIG. 1 but illustrating an alternative protuberance on the lower or running surfaces thereof. Ski section 16 has a central longitudinal protuberance 80 which is of substantially shallow rounded cross section located near the back end of the section, while rear section 18 has central and longitudinal protuberance 82 which is of shallow rounded cross section extending longitudinally of the ski section near the front end thereof. Otherwise these ski sections are the same as those of the previously-described from of the invention.

The illustrated ski apparatus is operated substantially in the same manner as an ordinary roller skate board. The user stands on platform 35 with his two feet in longitudinal alignment. He has to maintain his balance on the platform, and as long as he is standing with his weight centrally located on the skate board, he will travel straight ahead. The resilient connector 29 keeps the two ski sections 16 and 18 in proper longitudinal alignment. When the user wishes to make a turn, he inclines the platform by means of his feet in the direction of the turn while putting more weight on the front foot than on the back foot. This causes axle 36 to swing in the same direction thereby causing fore section 16 to turn to the same side. This section also inclines in the direction of turn, as illustrated in FIG. 5. The rear section 18 also inclines in the same direction, but connector 29 being attached to the back end 21 of the fore section which swings a little in the direction opposite to the direction of turn, causes the front end 21 of the rear ski section to swing a little in said opposite direction. This causes the back end of the platform to swing a little outwardly relative to the turn so that the apparatus turns more rapidly or moves through a tighter curve in the turn than would otherwise be the case.

FIG. 5 illustrates the fore section 16 inclined in a turn. At this time a substantial portion of the bottom surface on one side of the longitudinal centre line of the section is substantially flat on the snow. In this turn, runners 65 and 67 remain in the snow to reduce the amount of side slip as the apparatus makes the turn. An inertia tends to keep the apparatus travelling straight ahead, the raising of runner 68 and its side of the ski section prevents them from digging into the snow during the turn. Rear ski section 18 functions in the same manner at this time.

It will be noted that the protuberances 63 and 72 on the bottom surfaces of the front ski section and the back ski section respectively are located under the wheels of the skate board and therefore are directly under the foot of the user when the apparatus is being used. This allows for better control of the ski sections than would otherwise be the case.

FIGS. 7 and 8 illustrate fore ski section 16 and rear ski section 18 with alternative forms of protuberances 80 and 82 which are of substantially shallow rounded cross section. These protuberances function substantially in the same manner as the shallow V protuberances described above.

The fore and rear ski sections are interconnected by the flexible connector so that they can move both vertically and laterally to a limited extent relative to each other. The illustrated spring connector allows apparatus 10 to be fitted to ski boards of different lengths, and also acts as a shock absorber. The main thing is to have the two ski sections interconnected by a flexible connector. This invention also contemplates the formation of the two ski sections of strong rigid plastic interconnected by a relatively wide strip of plastic with a limited degree of flexibility.

While apparatus has been described and illustrated as a separate entity from skate board 12 it is to be understood that these may be combined as a permanent unit for use on snow. In this case, the wheels or rollers would not be necessary, and the ski sections would be directly connected to the transverse axles. However, the rollers may also be used in the permanent structure since the bearings thereof also act as bearings for the two ski sections.

I claim:

1. Snow ski apparatus comprising a fore ski section having a front end curved upwardly and a back end, said fore ski section being formed with a lower or running surface with a slight central protuberance of substantially shallow V-cross section extending longitudinally near the back end thereof, a rear ski section having a front end curved upwardly and a back end, said rear section being formed with a lower or running surface with a slight central protuberance of substantially shallow V-cross section extending longitudinally near the front end thereof, and being immediately behind and in longitudinal alignment with the fore ski section, the front end of the rear ski section overlapping the back end of the front ski section, a flexible connector connecting the front end of the rear section to the back end of the fore section, first mounting means on the fore section between the ends thereof adapted to clamp said fore section to the front rollers of a roller skate board, and second mounting means on the rear section between its ends adapted to clamping said rear section to the rear rollers of the skate board, said connector allowing limited relative vertical and horizontal movement between the fore ski section and the rear ski section.

2. Snow ski apparatus as claimed in claim 1 in which said flexible connector comprises a spring connected at opposite ends thereof to the fore ski section and the rear ski section.

3. Snow ski apparatus as claimed in claim 1 in which said flexible connector comprises a coil spring connected at opposite ends thereof to the fore ski section and the rear ski section.

4. Snow ski apparatus as claimed in claim 1 comprising a thin shallow runner extending centrally and longitudinally of the lower or running surface of the fore ski section near the back end thereof.

5. Snow ski apparatus as claimed in claim 4 comprising a thin shallow runner extending longitudinally of said lower or running surface adjacent each side edge of the fore ski section near the back end thereof.

6. Snow ski apparatus as claimed in claim 1 comprising a thin shallow runner extending centrally and longitudinally of the lower or running surface of the rear ski section near the front end thereof.

7. Snow ski apparatus as claimed in claim 6 comprising a thin shallow runner extending longitudinally of said lower or running surface adjacent each side edge of the rear ski section near the front end thereof.

8. Snow ski apparatus as claimed in claim 1 in which said first mounting means comprises a clamp adjacent each side edge of the fore ski section adapted to grip a portion of the roller on the front axle of the skate board.

9. Snow ski apparatus as claimed in claim 1 in which said second mounting means comprises a clamp adjacent each side edge of the rear ski section adapted to grip a portion of a roller on the rear axle of the skate board.

10. Snow ski apparatus comprising an elongate platform, a front transverse axle mounted on an under surface of the platform for limited lateral turning movement, a rear transverse axle mounted on said undersurface of the platform for limited lateral turning movement, rollers positioned at each end of each axle, a fore ski section having front end curved upwardly and a back end, said fore ski section being formed with a lower or running surface with a slight central protuberance of substantially shallow V-cross section extending longitudinally near the back end thereof, a rear ski section having a front end curved upwardly and a back end, said rear section being formed with a lower or running surface with a slight central protuberance of substantially shallow V-cross section extending longitudinally near the front end thereof, and being immediately behind and in longitudinal alignment with the fore section, the front end of the rear ski section overlapping the back end of the front ski section, a flexible connector connecting the front end of the rear section to the back end of the fore section, a clamp adjacent each side edge of the fore ski section of the roller skate board, a clamp adjacent each side edge of the rear ski section adapted to grip a portion of a roller on the rear axle of the roller skate board, said connector allowing limited relative vertical and horizontal movement between the fore ski section and the rear ski section.

* * * * *